US008692760B2

(12) United States Patent
Kang

(10) Patent No.: US 8,692,760 B2
(45) Date of Patent: Apr. 8, 2014

(54) BACKLIGHT UNIT, LIQUID CRYSTAL DISPLAY DEVICE USING THE SAME, AND METHOD FOR DRIVING BACKLIGHT UNIT

(75) Inventor: Tae-Uk Kang, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 281 days.

(21) Appl. No.: 12/979,931

(22) Filed: Dec. 28, 2010

(65) Prior Publication Data

US 2011/0279486 A1 Nov. 17, 2011

(30) Foreign Application Priority Data

May 11, 2010 (KR) ..... 10-2010-0043839

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS

| | | | | |
|---|---|---|---|---|
| 2002/0149576 | A1* | 10/2002 | Tanaka et al. | 345/204 |
| 2003/0058229 | A1* | 3/2003 | Kawabe et al. | 345/204 |
| 2006/0221629 | A1* | 10/2006 | Seong et al. | 362/561 |
| 2007/0176883 | A1* | 8/2007 | Hsu et al. | 345/102 |
| 2010/0110097 | A1* | 5/2010 | Nam et al. | 345/589 |
| 2010/0164857 | A1* | 7/2010 | Liu et al. | 345/102 |

FOREIGN PATENT DOCUMENTS

| | | |
|---|---|---|
| CN | 1174362 | 2/1998 |
| CN | 1811536 | 8/2006 |
| CN | 101114426 | 1/2008 |

* cited by examiner

*Primary Examiner* — Dorothy Harris
(74) *Attorney, Agent, or Firm* — McKenna Long & Aldridge LLP

(57) ABSTRACT

A backlight unit capable of preventing deterioration in image quality of a display image by controlling driving timing of a backlight in consideration of an operation speed of liquid crystal, a liquid crystal display device using the same, and a method for driving the backlight unit are disclosed. The backlight unit includes a backlight including a plurality of light sources to generate light, and a backlight control unit configured to control an on/off time of the backlight in units of at least one frame using an off time setting value set by a user and an external dimming control signal and to control the amount of light emitted from the backlight.

7 Claims, 4 Drawing Sheets

BACKLIGHT UNIT, LIQUID CRYSTAL DISPLAY DEVICE USING THE SAME, AND METHOD FOR DRIVING BACKLIGHT UNIT

This application claims the benefit of Korean Patent Application No. 10-2010-0043839, filed on May 11, 2010, which is hereby incorporated by reference as if fully set forth herein.

BACKGROUND OF THE INVENTION

1. Field of the Invention

The present invention relates to a backlight unit capable of preventing deterioration in image quality of a display image by controlling driving timing of a backlight in consideration of an operation speed of liquid crystal, a liquid crystal display device using the same, and a method for driving the backlight unit.

2. Discussion of the Related Art

With increasing adoption of information technology, demands for an image display device have been variously increased. Recently, a flat panel display device such as a Liquid Crystal Display (LCD) device, a Field Emission Display (FED) device, a Plasma Display Panel (PDP) device, or a Light Emitting Diode (LED) display device is mainly used.

An LCD device displays a desired image by adjusting transmission of light supplied from a backlight unit by a liquid crystal panel including a plurality of liquid crystal cells arranged in a matrix.

In the related art, fluorescent lamps have been used as the primary light sources for backlight units. However, recently, with increasing miniaturization, thinness and weight reduction of backlight units, a backlight unit using LEDs, which are advantageous in terms of power consumption, weight and luminance, as compared to fluorescent lamps, has been used.

Such a backlight unit adjusts the amount of driving current supplied to light sources such as LEDs so as to control the brightness of a backlight. In the related art, light with constant brightness may be supplied to a liquid crystal display device regardless of an image displayed on the liquid crystal display device. If the backlight is turned on or off regardless of a response speed of liquid crystal, a motion blurring phenomenon, in which a display image is blurred, occurs due to characteristics of liquid crystal having a low response speed.

In detail, in a liquid crystal display device, response speed is low due to characteristics such as inherent viscosity and elasticity of liquid crystal. In general, since the response speed of the liquid crystal is greater than a frame period (NTSC: 16.67 ms) of a moving display image, a frame transitions to a next frame before a voltage charged in a liquid crystal cell reaches a desired voltage. However, as described above, in the backlight unit of the related art, since the backlight is turned on or off regardless of the characteristics of the display image or the response speed of the liquid crystal, the image quality of the display image may be deteriorated.

SUMMARY OF THE INVENTION

Accordingly, the present invention is directed to a backlight unit, a liquid crystal display device using the same, and a method for driving the backlight unit that substantially obviate one or more problems due to limitations and disadvantages of the related art.

An object of the present invention is to provide a backlight unit capable of preventing deterioration in image quality of a display image by controlling driving timing of a backlight in consideration of an operation speed of liquid crystal, a liquid crystal display device using the same, and a method for driving the backlight unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a backlight unit includes a backlight including a plurality of light sources to generate light, and a backlight control unit configured to control an on/off time of the backlight in units of at least one frame using an off time setting value set by a user and an external dimming control signal and to control the amount of light emitted from the backlight.

The backlight control unit may include a driving voltage generation unit configured to supply a driving voltage to the light sources of the backlight, a driving Micro Controller Unit (MCU) configured to generate a Pulse Width Modulation (PWM) signal corresponding to a duty ratio of the dimming control signal and to generate a delay time setting value such that the PWM signal is delayed according to the off time setting value, and at least one backlight control IC configured to delay the PWM signal in correspondence with the delay time setting value and to supply or cut off backlight driving currents according to the delayed PWM signal.

The MCU may set the off time of the backlight in every frame period by the off time setting value set by the user, set a time when the PWM signal having a high level is input according to the duty ratio information of the dimming control signal, as the on time of the backlight, and set a time obtained by subtracting the on time of the backlight from the off time setting value as the delay time setting value of the PWM signal and supply the delay time setting value to the at least one backlight control IC.

The at least one backlight control IC may delay the PWM signal from the driving MCU during a period corresponding to the delay time setting value, supply light-source driving currents to the backlight according to the PWM signal in a high state so as to turn the backlight on, after the delay period, and cut off the light-source driving current from the backlight at a time when the PWM signal is switched to a low signal, such that the backlight is turned off.

The off time setting value may be a digital value of a period from a start time of every frame period to a time when the backlight is turned off, and may be set such that the backlight is turned off in synchronization with a falling time of liquid crystal of pixel regions included in any one horizontal line among a plurality of horizontal lines included in a liquid crystal display panel.

In another aspect of the present invention, a liquid crystal display device includes a liquid crystal panel including a plurality of pixel regions, a data driver configured to drive data lines of the liquid crystal panel, a gate driver configured to drive gate lines of the liquid crystal panel, a timing controller configured to align externally input image data, to supply the aligned image data to the data driver, to generate a dimming control signal and gate and data control signals, and to control the gate and data drivers, and the above-described backlight unit configured to irradiate light to the liquid crystal panel using the off time setting value set by the user and the dimming control signal.

In another aspect of the present invention, a method of driving a backlight unit including a backlight including a plurality of light sources and a backlight control unit configured to control the backlight includes controlling the amount of light emitted from the backlight by controlling an on/off time of the backlight using an off time setting value set by a user and an external dimming control signal.

The controlling of the amount of light may include generating a Pulse Width Modulation (PWM) signal corresponding to a duty ratio of the dimming control signal and generating a delay time setting value such that the PWM signal is delayed according to the off time setting value, and delaying the PWM signal in correspondence with the delay time setting value and supplying or cutting off backlight driving currents according to the delayed PWM signal.

The generating of the delay time setting value may include setting the off time of the backlight in every frame according to the off time setting value set by the user, setting a time when the PWM signal having a high level is input according to the duty ratio information of the dimming control signal, as the on time of the backlight, and setting a time obtained by subtracting the on time of the backlight from the off time setting value as the delay time setting value of the PWM signal.

The off time setting value may be a digital value of a period from a start time of every frame period to a time when the backlight is turned off, and may be set such that the backlight is turned off in synchronization with a falling time of liquid crystal of pixel regions included in any one horizontal line among a plurality of horizontal lines included in a liquid crystal display panel.

In the backlight unit, the liquid crystal display device using the same and the method of driving the backlight according to the embodiment of the present invention, the driving timing of the backlight is controlled in consideration of the operation speed of liquid crystal. Accordingly, it is possible to prevent deterioration in image quality of a display image.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, a backlight unit, a liquid crystal display device using the same and a method for driving the backlight unit according to an embodiment of the present invention will be described in detail with reference to the accompanying drawings.

Figure 1:
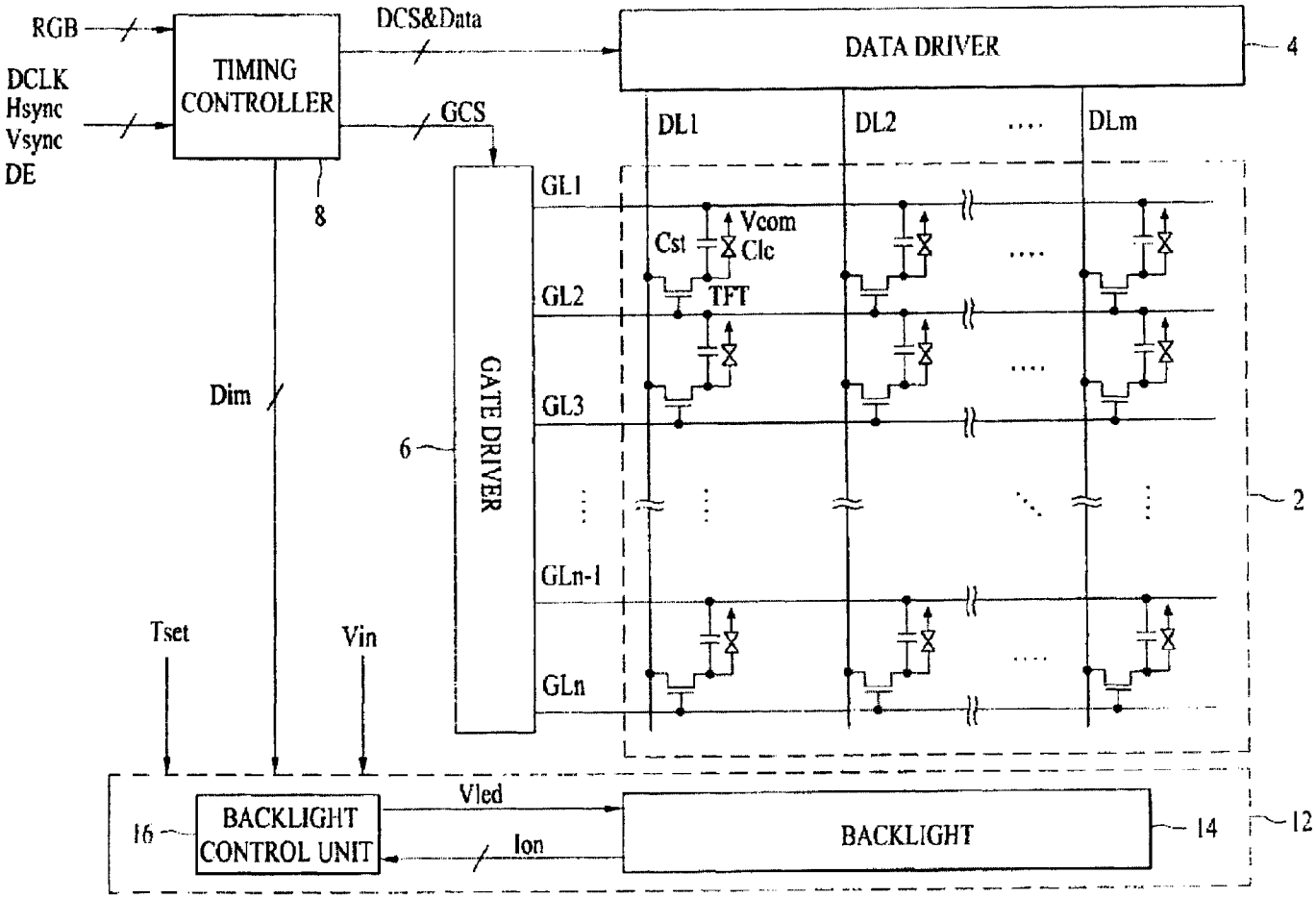
FIG. 1 is a diagram showing the configuration of a backlight unit and a liquid crystal display device using the same according to an embodiment of the present invention.

FIG. 1 is a diagram showing the configuration of a backlight unit and a liquid crystal display device using the same according to an embodiment of the present invention.

First, the liquid crystal display device shown in FIG. 1 includes a liquid crystal panel 2 which includes a plurality of pixel regions; a data driver 4 for driving data lines DL1 to DLm of the liquid crystal panel 2; a gate driver for driving gate lines GL1 to GLn of the liquid crystal panel 2; a timing controller 8 for aligning externally input image data RGB, supplying the aligned image data to the data driver 4, generating a dimming control signal Dim and gate and data control signals GCS and DCS, and controlling the gate and data drivers 4 and 6; and a backlight unit 12 controlling an on/off time of a backlight 14 using an off time setting value Tset set by a user and the dimming control signal Dim so as to irradiate light to the liquid crystal panel 2.

The liquid crystal panel 2 includes Thin Film Transistors (TFTs) formed in pixel regions defined by the plurality of gate lines GL1 to GLn and the plurality of data lines DL1 to DLm and liquid crystal capacitors Clc connected to the TFTs. Each liquid crystal capacitor Clc includes a pixel electrode connected to the TFT and a common electrode facing the pixel electrode with liquid crystal interposed therebetween. The TFTs supply image signals from the data lines DL1 to DLm to the pixel electrodes in response to scan pulses from the gate lines GL1 to GLn. Each liquid crystal capacitor Clc charges a difference voltage between the image signal supplied to the pixel electrode and a common voltage supplied to the common electrode and varies arrangement of liquid crystal molecules according to the difference voltage so as to adjust light transmission, thereby implementing a grayscale display. In addition, a storage capacitor Cst is connected to the liquid crystal capacitor Clc in parallel such that the voltage charged in the liquid crystal capacitor Clc is held until a next data signal is supplied. The storage capacitor Cst may be formed by laminating the pixel electrode on a storage line with an insulating film interposed therebetween.

The data driver 4 converts data compensated and converted by the timing controller 8 into an analog voltage, that is, an image signal, using the data control signal DCS from the timing controller 8, for example, a Source Start Pulse (SSP), a Source Shift Clock (SSC), a Source Output Enable (SOE) signal, etc. In detail, the data driver 4 latches image data aligned through the timing controller 8 according to the SSC and then supplies an image signal of one horizontal line to each of the data lines DL1 to DLm in every horizontal period in which a scan pulse is supplied to each of the gate lines GL1 to GLn. At this time, the data driver 4 selects a positive or negative gamma voltage with a predetermined level according to a grayscale value of the aligned image data and supplies the selected gamma voltage to each of the data lines DL1 to DLm as the image signal.

The gate driver 6 sequentially generates the scan pulse in response to the gate control signal GCS from the timing controller, for example, a Gate Start Pulse (GSP), a Gate Shift Clock (GSC) and a Gate Output Enable (GOE) signal and sequentially supplies the scan pulse to each of the gate lines GL1 to GLn. In other words, the gate driver 6 shifts the GSP from the timing controller 8 according to the GSC and sequentially supplies the scan pulse, for example, a gate on voltage, to each of the gate lines GL1 to GLn. In a period in which the gate on voltage is not supplied, a gate off voltage is supplied to each of the gate lines GL1 to GLn. The gate driver 6 controls the pulse width of the scan pulse according to the GOE signal.

The timing controller 8 aligns the externally input image data RGB to suit the driving of the liquid crystal panel 2 and supplies the aligned image data to the data driver 4 in units of at least one horizontal line. The timing controller 8 generates the gate and data control signals GCS and DCS using at least one of externally input synchronization signals such as a dot clock DCLK, a data enable signal DE, and horizontal and vertical synchronization signals Hsync and Vsync, and respectively supplies the gate and data control signals GCS and DCS to the gate and data drivers 6 and 4 so as to control the gate and data drivers 6 and 4. In addition, the timing controller 8 generates the dimming control signal Dim using at least one of the above synchronization signals according to brightness or luminance information of the aligned image data and supplies the dimming control signal to the backlight unit 12 so as to control the backlight unit 12.

The backlight unit 12 includes the backlight 14 including a plurality of light sources for generating light, an optical unit for improving efficiency of the light emitted from the plurality of light sources and a backlight control unit 16 for controlling the on/off time of the backlight 14 using the off time setting value Tset set by the user and the dimming control signal Dim so as to control the amount of light supplied to the liquid crystal panel 2.

The backlight 14 includes the plurality of light sources connected in series or in parallel and sequentially or simultaneously turns the light sources on or off according to a driving voltage Vled supplied to the light sources so as to generate light. The optical unit diffuses and focuses the light emitted from the light sources so as to improve light efficiency.

The light sources of the backlight 14 may include linear light sources, surface light sources, point light sources or a combination thereof. A Cold Cathode Fluorescent Lamp (CCFL), an External Electrode Fluorescent Lamp (EEFL), etc. may be used as the linear light source, and at least one Light Emitting Diode (LED), etc. may be used as the point light source. Hereinafter, an example of using at least one LED group, in which a plurality of LEDs is connected in series or in parallel, as the light sources of the backlight 14 will be described. Each LED group of the backlight 14 may include only white LEDs so as to generate white light or may include a combination of red, green and blue LEDs so as to generate white light. The plurality of LED groups generates light using the driving voltage Vled, and the light emission amount, that is, the brightness, of each LED group is controlled by LED driving current or a driving current supply period adjusted by an output terminal thereof.

The backlight control unit 16 sets the off time of the backlight 14 in frame period units according to the off time setting value Tset set by the user. The on time of the backlight 14 is set according to the set on time and the dimming control signal Dim from the timing controller. The backlight control unit controls light sources of the backlight 14 to be turned on at the set on time and to be turned off at the set off time, thereby controlling emission of light generated by the backlight 14.

In detail, the backlight control unit 16 first sets the off time of the backlight 14 in frame period units according to the off time setting value Tset. Then, a Pulse Width Modulation (PWM) signal is generated so as to correspond to a duty ratio of the dimming control signal Dim received externally or from the timing controller 8. The PWM signal is a signal in which an on/off period, for example, a high/low period, of each LED group is varied according to the duty ratio information of the dimming control signal Dim.

The backlight control unit 16 delays the PWM signal such that each LED group is turned on in synchronization with the set off time of the backlight 14 and then turns each LED group on using the delayed PWM signal. In other words, the backlight control unit 16 delays the PWM signal for a predetermined time such that the PWM signal is switched to a low signal at the set off time of the backlight 14 and then turns each LED group on according to the PWM signal in a high state after the delay period such that each LED group is turned off at the set off time of the backlight 14. The backlight control unit 16 adjusts an LED driving current output time output from each driving current output terminal of the backlight 14 according to the PWM signal delayed for the predetermined time so as to turn each LED group on/off such that each LED group is driven in a burst mode.

Figure 2:
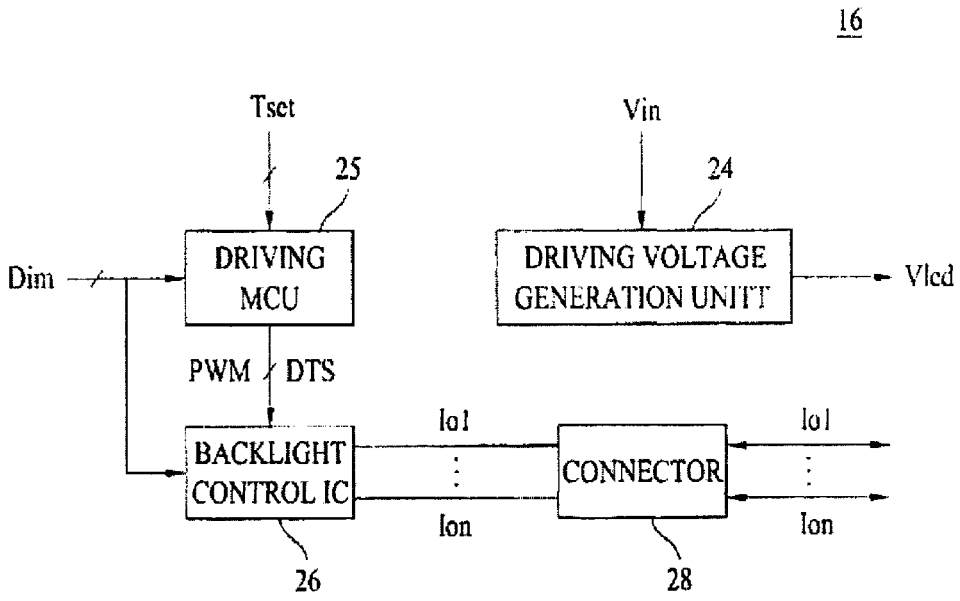
FIG. 2 is a diagram showing a backlight control unit shown in FIG. 1 in detail.

FIG. 2 is a diagram showing the backlight control unit shown in FIG. 1 in detail.

The backlight control unit 16 shown in FIG. 2 includes a driving voltage generation unit 24 for supplying the driving voltage Vled to the light sources of the backlight 14, a driving Micro Controller Unit (MCU) 25 for generating the PWM signal corresponding to the duty ratio of the dimming control signal Dim received externally or from the timing controller 8, generating the delay time setting value DTS so as to delay the PWM signal according to the off setting value Tset, and at least one backlight control IC 26 for delaying the PWM signal in correspondence with the delay time setting value DTS and supplying or cutting off the backlight driving current Io1 to Ion according to the delayed PWM signal.

At least one connector 28 is further included between each light source of the backlight 14, for example, the output terminal of each LED group, and each backlight control IC 26 so as to more stably supply each of the driving currents Io1 to Ion from the output terminal of each LED group to the backlight control IC 26.

The driving voltage generation unit 24 simultaneously or sequentially generates the driving voltage Vled suitable for the driving of a plurality of LED groups using an external voltage signal Vin and simultaneously and sequentially supplies the driving voltage to each of the plurality of LED groups. The driving voltage generation unit 24 may further include at least one register for storing data on characteristics of the driving voltage Vled supplied to each LED group, that is, characteristics of current amount and voltage level of each driving voltage Vled. If the driving current amounts or voltage levels vary due to a difference between the colors or characteristics of the LEDs included in each LED group, the driving voltage Vled may be generated so as to suit the driving characteristics of each LED group and may be supplied to each LED group.

The driving MCU 25 generates the PWM signal corresponding to the duty ratio of the dimming control signal Dim received externally or from the timing controller 8. The PWM signal is held at a high state in a period corresponding to 50% of a frame period if the duty ratio of the dimming control signal Dim is 50% and is held at a high state in a period corresponding to 30% of a frame period if the duty ratio of the dimming control signal Dim is 30%. The PWM signal is held at a low state in the period other than the period when the PWM signal is held at the high state. In addition, the driving MCU 25 generates the delay time setting value DTS such that the generated PWM signal is delayed according to the off time setting value Tset which is previously set and input by the user. In other words, the driving MCU 25 sets the delay time of the PWM signal such that the PWM signal is switched to the low signal at the off time of the backlight 14 according to the off time setting value Tset so as to turn the backlight 14 off. The value corresponding to the set delay time is supplied to the backlight control IC 26 as the delay time setting value DTS.

Figure 3:
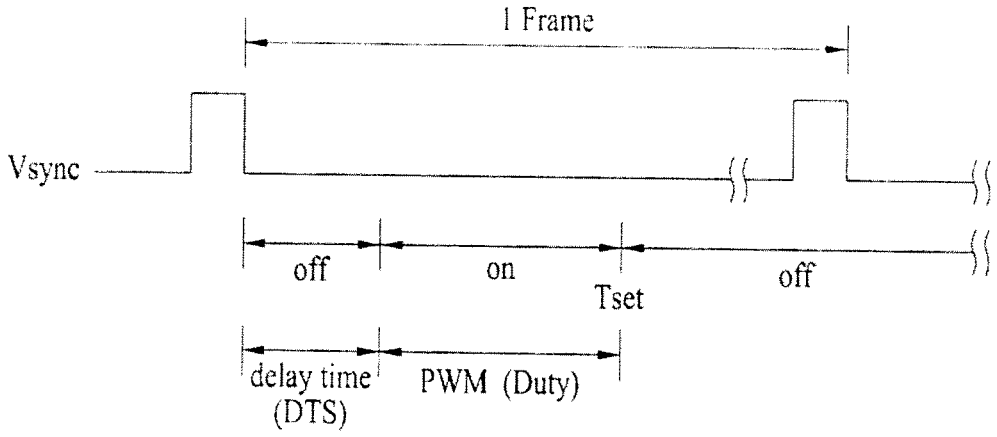
FIG. 3 is a diagram illustrating a method of generating a delay time setting value of a driving Micro Controller Unit (MCU) shown in FIG. 2.
Figure 4:
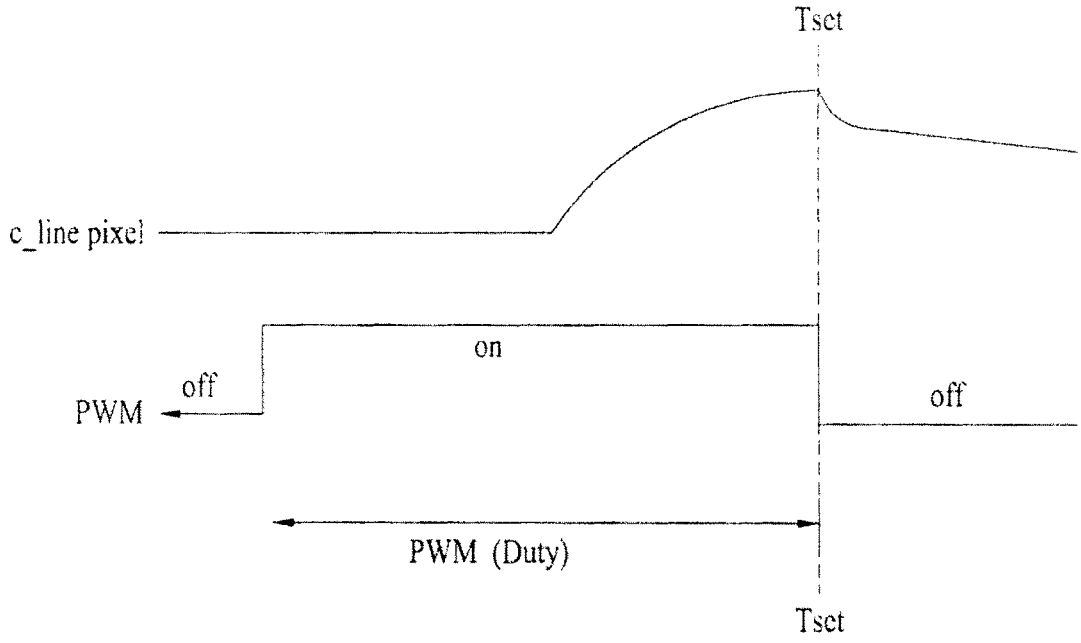
FIG. 4 is a diagram showing driving timing of a backlight according to an off time setting value.

FIG. 3 is a diagram illustrating a method of generating the delay time setting value of the driving MCU shown in FIG. 2. FIG. 4 is a diagram showing driving timing of the backlight according to the off time setting value.

Referring to FIG. 3, the external vertical synchronization signal Vsync is supplied in frame units so as to set a start time of every frame. The dimming control signal Dim supplied to the driving MCU 22 is input in units of at least one frame by predetermined duty ratio information. Accordingly, the driving MCU 22 generates the PWM signal in units of at least one frame so as to correspond to the duty ratio information of the dimming control signal Dim. The driving MCU 22 sets the delay time of the PWM signal according to the delay time setting value DTS such that the PWM signal is switched to the low signal at the off time of the backlight 14 according to the off time setting value Tset so as to turn the backlight 14 off. The off time setting value Tset is preset by the user in order to define a time when the backlight 14 is turned off in every frame and may be a digital value of a period from a start time of every frame to a time when the backlight 14 is turned off. The response speed of the liquid crystal may be varied according to the size of the liquid crystal panel 2 or the use of the liquid crystal panel 2. Accordingly, the off time setting time Tset of the backlight 14 used in the liquid crystal panel 2 is preferably preset by the user according to the experimental result.

As shown in FIG. 3, the delay time of the PWM signal set by the delay time setting value DTS may be a time obtained by subtracting the high period of the PWM signal, that is, the on time of the backlight 14, from the off time of the backlight 14, that is, the set off time setting value Tset.

As described above, the user may previously set the off time of the backlight 14 according to the off time setting value Tset in every frame period. In addition, the on time of the backlight 14 is the time during which the PWM signal having the high level is input according to the duty ratio information and the delay time of the PWM signal set by the delay time setting value DTS may be the delay time obtained by subtracting the on time of the backlight 14 from the off time setting value Tset. The driving MCU 22 supplies the delay time setting value DTS to the backlight control IC 26 together with the PWM signal such that the PWM signal is switched to the low signal at the off time of the backlight 14 so as to turn the backlight 14 off.

Accordingly, at least one backlight control IC 26 delays the PWM signal from the driving MCU 22 during a period corresponding to the delay time setting value DTS and then supplies the LED driving currents Io1 to Ion to the backlight 14 according to the PWM signal having the high state after the delay period so as to turn the backlight 14 on. When the PWM signal is switched to the low signal, the LED driving currents Io1 to Ion from the backlight 14 are cut off such that the backlight 14 is turned off. The backlight control IC 26 may control the on/off of the LED groups by delaying the PWM signal according to the delay time setting value DTS and switching the driving currents Io1 to Ion according to the delayed PWM signal. In this case, the LED groups may be driven in a burst mode.

As shown in FIG. 4, the off time setting value Tset which is preset by the user may be set in synchronization with a falling time of the liquid crystal of the pixel regions included in any one horizontal line among the plurality of horizontal lines included in the liquid crystal panel 2. In general, if the response speed of the liquid crystal is greater than one frame period (NTSC: 16.67 ms) of a moving display image, a frame transitions to a next frame before a voltage charged in a liquid crystal cell reaches a desired voltage. In the present invention, the off time setting value Tset is set such that the backlight 14 is turned off in synchronization with the falling time of the liquid crystal of the pixel regions c_line_pixel included in any one horizontal line among the plurality of horizontal lines.

If the backlight 14 is held at the on state during a period before the falling time of the liquid crystal of the pixel regions of any one horizontal line, that is, a rising period of the liquid crystal, the backlight 14 is turned off at the falling time, in which a motion blurring phenomenon occurs, so as to prevent deterioration in image quality. That is, in the present invention, since the driving timing of the backlight 14 is controlled according to the size of the liquid crystal panel 2 in consideration of the operation speed of the liquid crystal, it is possible to prevent deterioration in image quality of a display image.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A backlight unit comprising:

a backlight including a plurality of light sources to generate light; and a backlight control unit configured to control an on/off time of the backlight in units of at least one frame using an off time setting value set by a user and an external dimming control signal and to control the amount of light emitted from the backlight, wherein the backlight control unit includes, a driving Micro Controller Unit (MCU) configured to receive the external dimming control signal and to generate a pulse width modulation (PWM) signal corresponding to a duty ratio of the dimming control signal and to generate a delay time setting value (DTS) such that the PWM signal is delayed according to the off time setting value, wherein the DTS is generated by subtracting the on time of the backlight from the off time setting value; and at least one backlight control IC configured to receive the PWM signal and the DTS from the MCU and to receive the external dimming signal, wherein the at least one backlight control IC delays the PWM signal in correspondence with the DTS and supplies or cuts off backlight driving currents according to the delayed PWM signal, wherein the backlight control unit sets the off time of the backlight according to the off time setting value, and delays a Pulse Width Modulation (PWM) signal such that each LED group of the backlight is turned on in synchronization with the set off time of the backlight and then turns each LED group on using the delayed PWM signal, wherein the off time setting value is preset by the user as a digital value of a period from a start time of every frame period to a time when the backlight is turned off according to the size of the liquid crystal panel or the use of the liquid crystal panel, wherein the off time setting value is set such that the backlight is held at the on state during a rising period of liquid crystal of pixel regions included in any one horizontal line among a plurality of horizontal lines included in the liquid crystal display panel, and is set such that the backlight is turned off in synchronization with a falling time of liquid crystal of pixel regions included in any one horizontal line among a plurality of horizontal lines.

2. The backlight unit according to claim 1, wherein the backlight control unit includes:

a driving voltage generation unit configured to supply a driving voltage to the light sources of the backlight.

3. The backlight unit according to claim 2, wherein the MCU sets the off time of the backlight in every frame period according to the off time setting value set by the user, sets a time when the PWM signal having a high level is input according to the duty ratio information of the dimming control signal, as the on time of the backlight, and supplies the delay time setting value to the at least one backlight control IC.

4. The backlight unit according to claim 3, wherein the at least one backlight control IC delays the PWM signal from the driving MCU during a period corresponding to the delay time setting value, supplies light-source driving current to the backlight according to the PWM signal in a high state so as to turn the backlight on, after the delay period, and shuts off the light-source driving current supplied to the backlight when the PWM signal is switched to a low signal, such that the backlight is turned off.

5. A liquid crystal display device comprising:

a liquid crystal panel including a plurality of pixel regions;

a data driver configured to drive data lines of the liquid crystal panel;

a gate driver configured to drive gate lines of the liquid crystal panel;

a timing controller configured to align externally input image data, to supply the aligned image data to the data driver, to generate a dimming control signal and gate and data control signals, and to control the gate and data drivers; and the backlight unit according to any one of claims 1 to 4 configured to irradiate light to the liquid crystal panel using the off time setting value set by the user and the dimming control signal, wherein the backlight control unit includes, a driving Micro Controller Unit (MCU) configured to receive the external dimming control signal and to generate a PWM signal corresponding to a duty ratio of the dimming control signal and to generate a delay time setting value (DTS) such that the PWM signal is delayed according to the off time setting value, wherein the DTS is generated by subtracting the on time of the backlight from the off time setting value; and at least one backlight control IC configured to receive PWM signal from the MCU and the external dimming signal and to delay the PWM signal in correspondence with the delay time setting value and to supply or cut off backlight driving currents according to the delayed PWM signal.

6. A method of driving a backlight unit including a backlight including a plurality of light sources and a backlight control unit configured to control the backlight, the method comprising:

controlling the amount of light emitted from the backlight by controlling an on/off time of the backlight, wherein the controlling an on/off time of the backlight includes, receiving an external dimming control signal at a driving Micro Controller Unit (MCU);

generating a pulse width modulation (PWM) signal at the (MCU), wherein the PWM corresponds to a duty ratio of the dimming control signal;

generating a delay time setting value (DTS) at the MCU such that the PWM signal is delayed according to an off time setting value set by a user, wherein the DTS is generated by subtracting the on time of the backlight from the off time setting value; and receiving the PWM signal and the DTS at at least one backlight control IC from the MCU;

receiving the external dimming signal at the at least one backlight control IC;

delaying the PWM signal in correspondence with the DTS;

supplying or cutting off backlight driving currents according to the delayed PWM signal, wherein the off time of the backlight is set according to the off time setting value, and the PWM signal is delayed such that each LED group of the backlight is turned on in synchronization with the set off time of the backlight and then each LED group is turned on using the delayed PWM signal, wherein the off time setting value is preset by the user as a digital value of a period from a start time of every frame period to a time when the backlight is turned off according to the size of the liquid crystal panel or the use of the liquid crystal panel, wherein the off time setting value is set such that the backlight is held at the on state during a rising period of liquid crystal of pixel regions included in any one horizontal line among a plurality of horizontal lines included in the liquid crystal display panel, and is set such that the backlight is turned off in synchronization with a falling time of liquid crystal of pixel regions included in any one horizontal line among a plurality of horizontal lines.

7. The method according to claim 6, wherein the generating of the delay time setting value includes:

setting the off time of the backlight in every frame according to the off time setting value set by the user;

setting a time when the PWM signal having a high level is input according to the duty ratio information of the dimming control signal, as the on time of the backlight; and setting a time obtained by subtracting the on time of the backlight from the off time setting value as the delay time setting value of the PWM signal.

* * * * *